US005858173A

United States Patent [19]

Propst, Jr.

[11] Patent Number: 5,858,173

[45] **Date of Patent: *Jan. 12, 1999**

[54] PAPER MAKING PROCESS

[75] Inventor: Charles W. Propst, Jr., Gettysburg, Pa.

[73] Assignee: Tim-Bar Corporation, Hanover, Pa.

[ * ] Notice: The term of this patent shall not extend beyond the expiration date of Pat. No. 5,393,566.

[21] Appl. No.: 446,619

[22] PCT Filed: Jan. 6, 1995

[86] PCT No.: PCT/US95/00187

§ 371 Date: May 31, 1995

§ 102(e) Date: May 31, 1995

[51] Int. Cl.[6] ..... D21H 17/20; D21H 17/37; D21H 23/26

[52] U.S. Cl. ..... 162/164.1; 162/168.1; 162/189; 162/168.3

[58] Field of Search ..... 162/164.1, 168.1, 162/163, 189, 158, 168.3; 428/348, 349, 339

[56] References Cited

U.S. PATENT DOCUMENTS

| | | | |
|---|---|---|---|
| 2,970,079 | 1/1961 | Klacsmann . | |
| 3,901,857 | 8/1975 | Sackman et al. | 162/168.1 X |
| 4,088,530 | 5/1978 | Chan et al. | 162/168.3 |
| 4,167,439 | 9/1979 | Killam | 162/163 |
| 4,225,383 | 9/1980 | McReynolds | 162/156 |
| 4,313,790 | 2/1982 | Pelton et al. . | |
| 4,510,019 | 4/1985 | Bartelloni . | |
| 4,798,653 | 1/1989 | Rushmere | 162/168.3 |
| 4,845,148 | 7/1989 | Moore et al. | 524/512 |
| 5,160,484 | 11/1992 | Nicoloff | 427/439 |
| 5,176,797 | 1/1993 | Hartan et al. | 162/168.3 |
| 5,393,566 | 2/1995 | Propst, Jr. . | |
| 5,429,294 | 7/1995 | Propst . | |
| 5,492,733 | 2/1996 | D'Anna et al. . | |

FOREIGN PATENT DOCUMENTS

| | | | |
|---|---|---|---|
| 477265 | 9/1951 | Canada | 162/168.1 |
| 9325057 | 12/1993 | WIPO . | |
| 9426513 | 11/1994 | WIPO . | |

*Primary Examiner*—Stanley S. Silverman
*Assistant Examiner*—Jose A. Fortuna
*Attorney, Agent, or Firm*—Stevens, Davis, Miller & Mosher, L.L.P.

[57] ABSTRACT

A process for the manufacture of a paper having improved grease and water resistance, yet facilitating recycling of the paper is achieved by applying a recyclable plastic coating to a paper making machine.

17 Claims, 2 Drawing Sheets

PAPER MAKING PROCESS

This application is a 371 of PCT/US95/00187 filed Jan. 6, 1995.

1. Field of the Invention

The present invention is directed to the papermaking arts, more particularly to a process for the manufacture of a paper having improved grease and water resistance, yet facilitating recycling of the paper. Such papers (throughout the specification and claims "papers" includes virgin or recycled paper, kraft stock and similar materials) find particular application in the container making art wherein such improved properties are desirable. The container making art, particularly, in the field of corrugated containers, folding cartons, and the tray and box industries, consumes much of the natural timber resources. Thus, it would be beneficial to formulate new processes of forming papers of improved grease and water resistance properties which would be recyclable.

2. Description of the Related Art

The art of "papermaking" is an ancient one, being attributable to invention by the Chinese before the birth of Christ.

More modern developments resulted in the widely accepted Fourdrinier process (See *Kirk-Othmer Encyclopedia of Chemical Technology,* 3rd ed., Vol. 9, pp. 846–7, John Wiley & Sons, New York 1980) in which a "furnish" (a "furnish" is predominantly water, e.g., 99.5% by weight and 0.5% "stock" ("stock" being virgin, recycled or mixed virgin and recycled pulp of wood fibers, fillers, sizing and/or dyes) is deposited from a headbox on a "wire" (a fast-moving foraminous conveyor belt or screen) which serves as a table to form the paper. As the furnish moves along, gravity and suction boxes under the wire draw the water out. The volume and density of the material and the speed at which it flows onto the wire determine the paper's final weight.

Typically, after the paper leaves the "wet end" of the papermaking machine, it still contains a predominant amount of water. Therefore, the paper enters a press section, which can be a series of heavy rotating cylinders, which press the water from the paper, further compacting it and reducing its water content, typically to 70% by weight.

Subsequent to pressing the paper enters a drying section. Typically, a drying section is the longest part of the paper machine. Hot air or steam heated cylinders contact both sides of the paper, evaporating the water to a low level, e.g., 5% by weight of the paper.

The paper optionally passes through a sizing liquid to make it less porous and to help printing inks remain on the surface instead of penetrating the paper. The paper can go through additional dryers that evaporate the liquid in the sizing and coating. Calenders or polished steel rolls make the paper even smoother and more compact. While most calenders add gloss, some calenders are used to create a dull or matte finish.

The paper is wound onto a "parent" reel and taken off the paper making machine.

The paper on the parent reel can be further processed, such as on a slitter/winder, into rolls of smaller size or fed into sheeters, such as folio or cut-size sheeters, for printing end uses or even office application.

In order to make containers, rolls formed by slitter/winder (e.g., of paper and kraft grades of liner) are unwound and coated with a wax. Waxes impart water resistance and wet strength to the liner but inhibits recycling the used containers incorporating them. Additionally, the prior art wax coated liners must be adhered to the other components of the container with hot melt adhesives. These hot melt adhesives are a further impediment to recycling of formed containers employing wax coated components. Thus, there still exists a need for manufacturing paper possessing superior wet strength and water and grease resistance properties but facilitating recycling thereof.

SUMMARY OF THE INVENTION

In one embodiment the invention is directed to a process for making paper wherein a furnish is deposited on a wire and dewatered, characterized in:

adding to the furnish a recyclable plastic coating.

In another embodiment, the invention is directed to a process for making paper wherein a furnish is deposited on a wire and dewatered to form a paper, and the dewatered paper is subsequently pressed a number of times to further reduce the water content of the paper, characterized in adding a recyclable plastic coating to at least one side of the dewatered paper subsequent to a first pressing step.

In a still further embodiment, the invention is directed to a process for making paper wherein a furnish is deposited on a wire and dewatered, the dewatered paper is subsequently pressed to further reduce the water content of the paper and subsequently calendered, characterized in introducing to at least one side of the paper a recyclable plastic coating between the pressing and calendering steps.

A further embodiment discloses a process for making paper characterized in the following steps:

(a) applying a furnish to a wire, (b) dewatering the furnish and obtaining a water containing paper, (c) pressing the water containing paper to reduce the water content, (d) calendering the pressed paper, (e) recovering a finished paper, and (f) adding a recyclable plastic coating during the paper making process.

DETAILED DESCRIPTION OF THE INVENTION

Figure 1:
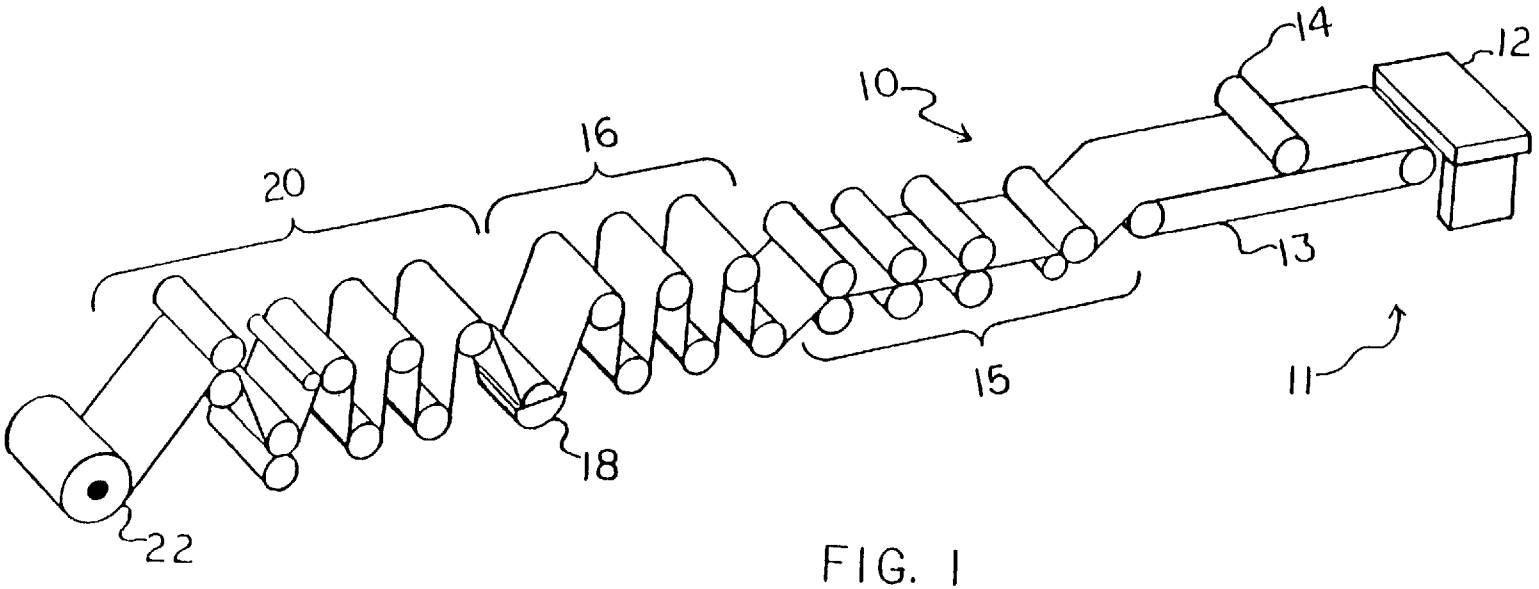
FIG. 1 is a perspective, schematic view of a typical paper-making machine.

A typical paper making machine is illustrated generally at 10 in FIG. 1. Normally it comprises a "wet end" 11 including a headbox 12, a wire 13 and a press section 15, a drying section 16, a size press 18, calender section 20 and parent reel 22. Optionally, a dandy roll 14 is positioned about two thirds of the way down the wire to level the fibers and make the sheet more uniform. Gravity and suction boxes (not shown) are positioned underneath the wire to remove water from the furnish.

The stock fed to the headbox 12 can be virgin, recycled or a mixture of virgin and recycled pulp. In the headbox 12, the stock is mixed with water to form a furnish for deposit onto the wire.

In the invention, a recyclable plastic coating (RPC) is incorporated during the papermaking process. It should be understood that in this invention and throughout the specification and claims, "coating" means "coating" or "impregnation" unless otherwise indicated.

For example, a typical (RPC) composition is an aqueous acrylic resin based composition. A preferred three-component composition according to the following formula

| TYPICAL CHARACTERISTICS | |
|---|---|
| COMPONENT A | |
| Appearance | Amber clear solution |
| Non-volatile | 34.0 ± 0.5% resins solids |
| pH | 8.3–8.6 |
| Viscosity | 2500 ± 500 cps (Brookfield) |
| Lbs./gal. | 8.7 ± 0.1 |
| Density | 1.07 |
| Acid Number | 70 |
| Tg. | 95° C. |
| Flash point | 115° P |
| Freeze/Thaw Stability | Yes |
| COMPONENT B | |
| Appearance | Translucent Emulsion |
| Non-volatiles | 40% |
| pH | 2.5–3.5 |
| Viscosity | 25–35 cps |
| Weight per gallon | 8.7 lbs. |
| M.F.T. | 8° C. |
| Tg | 0° C. |
| Acid number | 58 (@ 100% NV) |
| COMPONENT C | |
| A 35% solids polyethylene wax emulsion having the following typical properties: | |
| Non-volatiles | 34.7–35.3% |
| pH | 9.0–9.5 |
| Weight per gallon | 8.27 lbs. |

is supplied to the headbox 12. Components A, B and C are mixed in approximate parts by weight of 15:65:6 in admixture with 5.5 HOH, 0.5 $NH_4OH$, 3 zinc oxide "solution" (actually a dispersion), under strong agitation. All of the foregoing proportions can be varied plus or minus 10% and still display the performance of the RPC. In fact, Component A and B can be varied plus or minus 20% and Component C can be completely removed from the formulation or be substituted by other synthetic polyethylene waxes while still achieving the desired results of the invention. The percent solids of the composition supplied to headbox 12 or used at other coating locations according to the invention can typically be varied from about 3.0% to about 20% by weight.

Components A, B and C are mixed in approximate parts (by weight) of 15:65:6 in admixture with 5.5 HOH, 0.5 $NH_4OH$, 3 zinc oxide solution, under strong agitation.

The Components A, B and C, to be used in formulating the composition of the invention, are commercially available from S. C. Johnson & Sons, Inc., U.S. Specialty Chemicals, 1525 Howe Street, Racine, Wis. under the trademarks JONCRYL 61LV, JONCRYL 82 and JONCRYL 28, respectively.

JONCRYL 82 is a acrylic based composition compatible with various solvents including methanol, 3A ethanol, isopropanol, n-propanol, ethylene glycol monobutyl ether, diethylene glycol monoethyl ether, acetone, methylene ketone and methyl isobutyl ketone. Heat resistance of JONCRYL 82 can be further increased by crosslinking the polymer with a zinc oxide solution which produces stable viscosities at higher pH. The maximum workable pH of JONCRYL 82 can be increased from 7 to 9 by incorporating a zinc oxide solution.

JONCRYL 61LV can be formulated in a ball-mill or high shear dispersion of up to 40% organic and 70% inorganic pigment. Unlike other acrylic polymer dispersions, JONCRYL 61LV does not become thixotropic at high pH. JONCRYL 61LV is compatible with caseins, shellacs and resin ester maleics, as well as other acrylic resins.

However, more or less than 3.0–20% by weight of the aqueous composition can be incorporated in the stock or finished paper. The following Examples will demonstrate the wide variation in RPC content.

EXAMPLE 1

Within the laboratory environment, liner board was repulped to conform with the consistency of pulped fiber processed in an average paper mill machine. At this point, the fiber was separated into four separate beakers each with 100 grams of fiber. To beaker number 1, 5.0 grams of RPC was added. In beaker number 2, 10.0 grams of RPC was added. In beaker number 3, 20.0 grams of RPC was added. In beaker number 4, 30.0 grams of RPC was added.

After stirring the fiber mixed with RPC at various levels, the fiber from each beaker was applied to a wire mesh which would simulate the wire mesh of a paper machine which allows the fiber to drain by gravity or assisted through a particle vacuum action that starts the removal of fluids on the paper machine. Through gravity and compression in the laboratory environment, excess fluids were driven out of the fiber of each test sample, one through four. To simulate paper machine drying the fiber, still on the wire mesh, was dried by infra-red heat. After all four test samples were dried, the surfaces were tested for grease resistance and water resistance. A fifth sample was repulped, screened and dried without any RPC to be the control. Samples one through four showed improved grease and water resistance when compared to the control. The final phase was to repulp samples one through four, rescreen and dry. The final step in the process to determine success is examining the dry reformed paper under a microscope to determine the presence of undissolved foreign matter that would indicate a failure to repulp. The examination revealed that no undissolved material were present, indicating success in creating a barrier and having the barrier, RPC, dissolve and allow no foreign matter to be present in any beaker marked one through four. The foregoing experiment is indicative of addition of RPC to the stock or furnish prior to deposit on the wire of a paper making machine.

The next step in taking the invention from the laboratory to a commercially viable process was to introduce the RPC at different locations in conventional paper making machines.

A position on the paper machine downstream of the headbox 12 was selected for a manual "pour on" of liquid RPC on an edge of the paper approximately 24 inches (58.8 cm) of the width of the paper machine, in the amount of 5 gallons (18.92 1). This section of treated paper was tracked through the paper machine and retrieved at the dry end of the machine. This retrieval section was tested for grease and water resistance and showed improvement in both areas.

RPC was next applied with a spraybar, the application rate applied from a minimum value, but sufficient to create perceptible enhancements to liner or medium, to approximately 40% by weight of paper, pH varied from 5.5 to 8.0.

The RPC was applied at the wet end via spray application to the top side of the sheet during a run of 26# medium. The trial spray head was positioned at:

(1) the wet/dry line on the wire, and (2) after the second press, before the dryer.

Subsequently, the RPC was applied via calender stock treatment to a 69# special liner. The purpose of this trial was to ascertain the viability of this application technique utilizing two water boxes on one side. The results of this latter trial is as follows:

| | | 69# Special Liner | |
|---|---|---|---|
| | Reg 69# Liner | Treated One Side | Treated Two Sides |
| Basis Wgt MSF | 69 | 69.1 | 69.8 |
| Caliper | 19.0 | 20.0 | 19.5 |
| Mullen Min | 128 | 117 | 120 |
| STFI MD | 46–69 | 52 | 65 |
| CD | 32–47 | 23.75 | 28.4 |
| Cobb 1-min T/B gms. | — | .37/.17 | .20/.06 |
| Scott plybond | — | 95 | 100 |
| Porosity Sec | 8 | 700+ | 1200+ |

Figure 2:
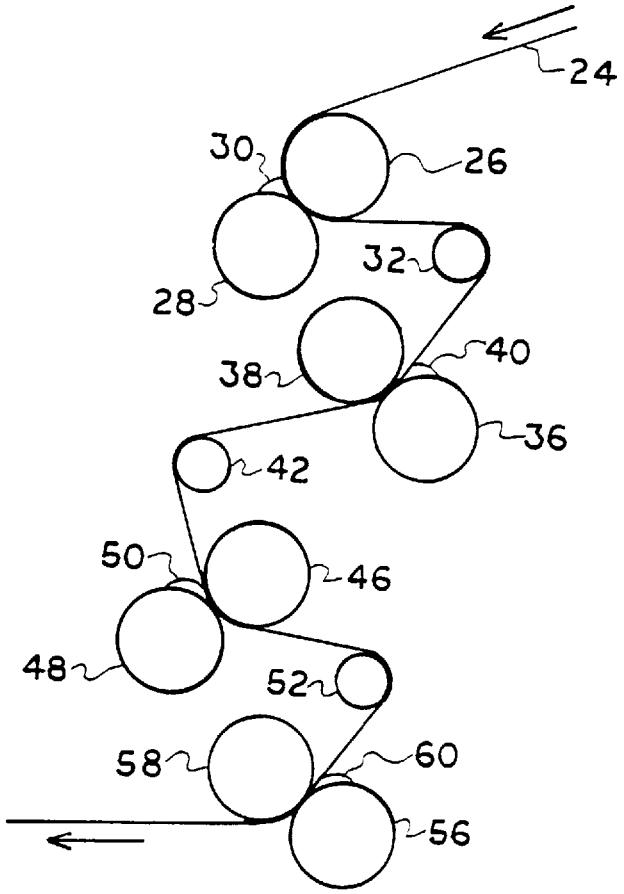
FIG. 2 is a schematic, side view of an alternative coating method.

Alternatively, as shown in FIG. 2, coating on both sides of a moving paper web 24 can be effected by passing web 24 between the nip of rollers 26, 28 in which a bank 30 of RPC is found thereby applying the RPC to one side of web 24. After passing over idler roll 32, the other side of the web 24 can be coated by bank 40 and rollers 36, 38. Additional layers of coating may be applied one or more times to either or both sides of web 24 by additional rollers 46, 48, 56, 58 and banks 50 and 60. Additional idler rolls 42, 52 may be provided to convey and tension web 24. The device of FIG. 2 can be used prior to, subsequent to or in place of size press 18 of FIG. 1. It should be understood that additional rollers (not shown), banks (not shown) and even idler rolls (not shown) may be employed to apply as many additional layers of RPC as desired. Additionally, sizing agents may be incorporated into one or more of the banks of RPC.

All of the foregoing tests produced a paper that was repulpable. In addition, the addition of RPC appears to dramatically increase fiber strengths. Using 100% recycled fiber treated with RPC increased fiber strengths, giving strengths of 90% of virgin fiber, whereas normal recycled fiber are approximately 60% of virgin fiber.

The process of paper making can be modified to include RPC addition at the headbox (or even upstream of the headbox when the stock is mixed with fillers, sizing or dyes), in the press section at any point subsequent to the first press, and subsequent to the drying section, either at or in place of the size press but before the calenders.

The papers coated by the process find special use in the following industries, the label industry, especially the 60#/3000 S.F. label industry, folding carton, tray and box (all board weights) and liquid packs, such as water, soda, and milk, ice cream, yogurt and delicatessen carry-out containers.

The fine paper industry for barrier containers and interleaves for between sensitive paper or metallized papers or photographic plates can also benefit from the invention.

By using the invention to apply a coating formulation into a paper making machine the following benefits are achieved:

(1) the overall cost of the finished coated/impregnated liner or paper is reduced, and (2) incorporating the technology into the paper making machine (process) would allow the technology to reach its maximum potential.

Although the present invention has been described in terms of specific embodiments, it will be apparent to one skilled in the art that various modifications may be made according to those embodiments without departing from the scope of the applied claims and their equivalents. Accordingly, the present invention should not be construed to be limited to the specific embodiments disclosed herein.

I claim:

1. In a process for making paper wherein a furnish is deposited on a wire and dewatered, the improvement comprising:

adding to the furnish an effective amount of a repulpable acrylic resin-containing composition wherein the acrylic resin-containing composition is at a pH of at least 5.5 and further comprises zinc oxide in an amount effective to crosslink the acrylic resin.

2. The process of claim 1 wherein the paper made is one selected from liner and medium.

3. The process of claim 1 wherein the furnish is a mixture of stock and water and said acrylic resin-containing composition is added to said mixture before the furnish is deposited on said wire.

4. The process of claim 1 wherein the furnish is a mixture of stock and water and said repulpable acrylic based resin composition is added to said mixture at the wet/dry line on said wire.

5. The process of claim 1 wherein the furnish is a mixture of stock and water and the stock is a pulp selected from the group consisting of virgin, recycled and mixtures thereof.

6. The process of claim 5 wherein the stock is a recycled pulp and said recycled pulp contains an acrylic based resin component.

7. In a process for making paper, wherein a furnish is deposited on a wire and dewatered to form a paper, and the dewatered paper is subsequently pressed a number of times to further reduce the water content of the paper, the improvement comprising adding an effective amount of a repulpable acrylic resin-containing composition at a pH of at least 5.5, said acrylic resin-containing composition including zinc oxide in an amount effective to crosslink the acrylic resin, to at least one side of the dewatered paper subsequent to a first pressing step.

8. The process of claim 7 wherein the repulpable acrylic resin-containing composition is applied to both sides of the dewatered paper subsequent to a first pressing step.

9. The process of claim 7 wherein the paper made is one selected from liner and medium.

10. In a process for making paper wherein a furnish is deposited on a wire and dewatered to form a paper, the dewatered paper is subsequently pressed to further reduce the water content of the paper and is subsequently calendered, the improvement comprising introducing to at least one side of the paper an effective amount of a repulpable acrylic resin-containing composition at a pH of at least 5.5, said acrylic resin-containing composition including zinc oxide in an amount effective to crosslink the acrylic resin, between the pressing and calendering steps.

11. The process of claim 10 wherein the paper made is one selected from liner and medium.

12. The process of claim 10 wherein the repulpable acrylic resin-containing composition is introduced to both sides of the paper.

13. A process for making paper comprising the following steps:

(A) applying a furnish to a wire;

(B) dewatering the furnish and obtaining a water containing paper;

(C) pressing the water containing paper to reduce the water content;

(D) calendering the pressed paper;

(E) recovering a finished paper; and (F) adding an effective amount of a repulpable acrylic resin-containing composition containing zinc oxide in an amount effective to crosslink the acrylic resin, said resin composition having a pH of at least about 5.5, at any point during said paper making process.

14. The process of claim 13 wherein said repulpable acrylic resin-containing composition is added more than once during said paper making process.

15. In a process for making paper wherein a furnish is deposited on a wire and dewatered, the improvement comprising adding to the furnish an effective amount of a repulpable acrylic based resin composition wherein the acrylic based resin composition consists of the following components:

(A) 15 parts by weight of an aqueous acrylic resin emulsion having 34.0±0.5% non-volatiles, a pH of 8.3–8.6, a viscosity (Brookfield) of 2500±500 cps, a density of 1.07, an acid number of 70, a $T_g$ of 95° C. and a flashpoint of 115° C.;

(B) 65 parts by weight of an aqueous acrylic resin emulsion having 40% non-volatiles, a pH of 2.5–3.5, a viscosity of 25–35 cps, a weight per gallon of 8.7 pounds, an M.F.T. of 8° C., a $T_g$ of 0° C. and an acid number of 58 (@ 100% non-volatiles);

(C) 6 parts by weight of an aqueous polyethylene was emulsion having 34.7–35.3% non-volatiles, a pH of 9.0–9.5 and a weight per gallon of 8.27 pounds;

(D) 5.5 parts by weight HOH;

(E) 0.5 parts by weight $NH_4OH$; and (F) 3 parts by weight zinc oxide solution.

16. In a process for making paper wherein a furnish is deposited on a wire and dewatered to form a paper, and the dewatered paper is subsequently pressed a number of times to further reduce the water content of the paper, the improvement comprising adding an effective amount of a repulpable acrylic based resin composition to at least one side of the dewatered paper subsequent to a first pressing step wherein the acrylic based resin composition consists of the following components:

(A) 15 parts by weight of an aqueous acrylic resin emulsion having 34.0±0.5% non-volatiles, a pH of 8.3–8.6, a viscosity (Brookfield) of 2500±500 cps, a density of 1.07, an acid number of 70, a $T_g$ of 95° C. and a flashpoint of 115° C.

(B) 65 parts by weight of an aqueous acrylic resin emulsion having 40% non-volatiles, a pH of 2.5–3.5, a viscosity of 25–35 cps, a weight per gallon of 8.7 pounds, an M.F.T. of 8° C., a $T_g$ of 0° C. and an acid number of 58 (@ 100% non-volatiles);

(C) 6 parts by weight of an aqueous polyethylene wax emulsion having 34.7–35.3% non-volatiles, a pH of 9.0–9.5 and a weight per gallon of 8.27 pounds;

(D) 5.5 parts by weight HOH;

(E) 0.5 parts by weight $NH_4OH$; and (F) 3 parts by weight zinc oxide solution.

17. In a process for making paper wherein a furnish is deposited on a wire and dewatered, the dewatered paper is subsequently pressed to further reduce the water content of the paper and subsequently calendered, the improvement comprising introducing to at least one side of the paper an effective amount of a repulpable acrylic resin based composition between the pressing and calendering steps wherein the acrylic based resin composition consists of the following components:

(A) 15 parts by weight of an aqueous acrylic resin emulsion having 34.0±0.5% non-volatile, a pH of 8.3–8.6, a viscosity (Brookfield) of 2500±500 cps, a density of 1.07, an acid number of 70, a $T_g$ of 95° C. and a flashpoint of 115° C.;

(B) 65 parts by weight of an aqueous acrylic resin emulsion having 40% non-volatiles, a pH of 2.5–3.5, a viscosity of 25–35 cps, a weight per gallon of 8.7 pounds, an M.F.T. of 8° C., a $T_g$ of 0° C. and an acid number of 58 (@ 100% non-volatiles);

(C) 6 parts by weight of an aqueous polyethylene wax emulsion having 34.7–35.3% non-volatiles, a pH of 9.0–9.5 and a weight per gallon of 8.27 pounds;

(D) 5.5 parts by weight HOH;

(E) 0.5 parts by weight $NH_4OH$; and (F) 3 parts by weight zinc oxide solution.

* * * * *